US006851518B1

(12) United States Patent
Walker

(10) Patent No.: US 6,851,518 B1
(45) Date of Patent: Feb. 8, 2005

(54) LADDER STABILIZER

(76) Inventor: James Scott Walker, 3508 SW. 127th St., Oklahoma City, OK (US) 73170

( * ) Notice: Subject to any disclaimer, the term of this patent is extended or adjusted under 35 U.S.C. 154(b) by 0 days.

(21) Appl. No.: 10/452,737

(22) Filed: Jun. 2, 2003

Related U.S. Application Data

(60) Provisional application No. 60/387,014, filed on Jun. 7, 2002.

(51) Int. Cl.[7] ..... E04G 5/02; E06C 7/06

(52) U.S. Cl. ..... 182/107; 182/214; 182/129; 248/210

(58) Field of Search ..... 182/129, 230, 182/107, 214, 108; 248/210, 238

(56) References Cited

U.S. PATENT DOCUMENTS

| | | | | |
|---|---|---|---|---|
| 4,061,203 A | * | 12/1977 | Spencer et al. | 182/214 |
| 4,502,566 A | * | 3/1985 | Wing | 182/214 |
| 5,010,979 A | | 4/1991 | Shreve, III | |
| 5,113,973 A | | 5/1992 | Southern | |
| 5,121,814 A | * | 6/1992 | Southern | 182/214 |
| 5,242,031 A | * | 9/1993 | Ashley | 182/214 |
| D366,319 S | | 1/1996 | Sheftel | |
| D406,652 S | | 3/1999 | Marchand | |
| 6,250,424 B1 | | 6/2001 | Laug | |
| 6,394,229 B1 | | 5/2002 | Hastreiter | |
| 6,408,983 B1 | | 6/2002 | Widurski | |
| 6,691,825 B2 | * | 2/2004 | Haig | 182/107 |

* cited by examiner

*Primary Examiner*—Hugh B. Thompson, II
(74) *Attorney, Agent, or Firm*—Randal D. Homburg

(57) ABSTRACT

A ladder stabilizer adapted to attach to an upper end or lower end of an extension ladder includes a mounting plate connecting to a rung of the extension ladder by secure U-bolts, the mounting plate attached to a slide bar mounting bracket having a transverse channel with a tightening screw providing a force within the channel to lock and hold a pair of extendable service arms within the transverse channel to provide additional wide and secure lateral stabilization of the extension ladder either at the top of the extension ladder, where the extension ladder rests against a wall or roof, or at the bottom of the extension ladder where the extension ladder meets the ground.

4 Claims, 4 Drawing Sheets

LADDER STABILIZER

CROSS REFERENCE TO RELATED APPLICATIONS

Applicant claim the benefit of Provisional Patent Application No. 60/387,014 filed on Jun. 7, 2002.

I. BACKGROUND OF THE INVENTION

1. Field of Invention

A ladder stabilizer adapted to attach to an upper end or lower end of an extension ladder includes a mounting plate connecting to a rung of the extension ladder by secure U-bolts, the mounting plate attached to a slide bar mounting bracket having a transverse channel with a tightening screw providing a force within the channel to lock and hold a pair of extendable service arms within the transverse channel to provide additional wide and secure lateral stabilization of the extension ladder either at the top of the extension ladder, where the extension ladder rests against a wall or roof, or at the bottom of the extension ladder where the extension ladder meets the ground.

2. Description of Prior Art

The following United States patents were discovered and are disclosed within this application for utility patent. All relate to extension ladder stabilizers or support devices.

In two U.S. Des. Pat. No. D406,652 to Marchland and U.S. Pat. No. D366,319 to Sheftel, ladder stabilizers are shown having two sliding adjustment arms attached to a singular tube having hooks attaching a frame to a ladder and a simple unitary bent bar, respectively. U.S. Pat. No. 5,113,973 to Southern, shows a ladder having a unitary central tube with two laterally extending bent arms with swivel tips extending from the central tube, the central tube connected to the ladder frame by two diagonal brackets, the arms being held within the tube by a bolt or a pin. U.S. Pat. No. 5,010,979 to Shreve, III discloses a single bent bar held onto the ladder frame by a pair of U-bolts, with the single support bar bolted to a channel in a leveling attachment.

II. SUMMARY OF THE INVENTION

The American Academy of Orthopedic Surgeons recently released statistics illustrating the dangers associated with ladder accidents. In the United States alone, more than 500,000 people each year suffer ladder related injuries, which does not include those who receive injury and fail to seek medical care, over 300 people in this country die each year from ladder related injuries. Estimated cost of ladder related injuries is over 11 billion dollars annually, including loss of work, medical, legal, liability and pain and suffering expenses.

Part of the solution to this problem is choosing a safe ladder upon which to work, including selection of a ladder with a proper weight rating. A second preventive measure is to set the ladder on a stabile surface before working. In the event an extension ladder is chosen, selection of a ladder with proper height is also important. However, even following these guidelines can still leave accidents waiting to happen, since extension ladders may still teeter and move laterally when resting against walls roofs or other surfaces.

The primary objective of the current invention is to provide a ladder stabilizer that is extendable to prevent lateral movement of a ladder against a flat surface. A second objective of the invention is to allow for the placement of an extension ladder on a non-flat surface, including a roof, with extendable support for any pitch surface, from horizontal to vertical. A third objective is to provide the ladder stabilizer for use on the bottom of an extension ladder for stable contact with the ground in a variety of configurations. A fourth objective of the ladder stabilizer is to provide the extension arms to be adjusted to wrap and secure a round pole to prevent lateral movement while working on a utility or sign pole.

III. DESCRIPTION OF THE DRAWINGS

The following drawings are submitted with this utility patent application.

FIGS. 3*a* and 3*b* are perspective views of the second embodiment service arms.

Figure 1:
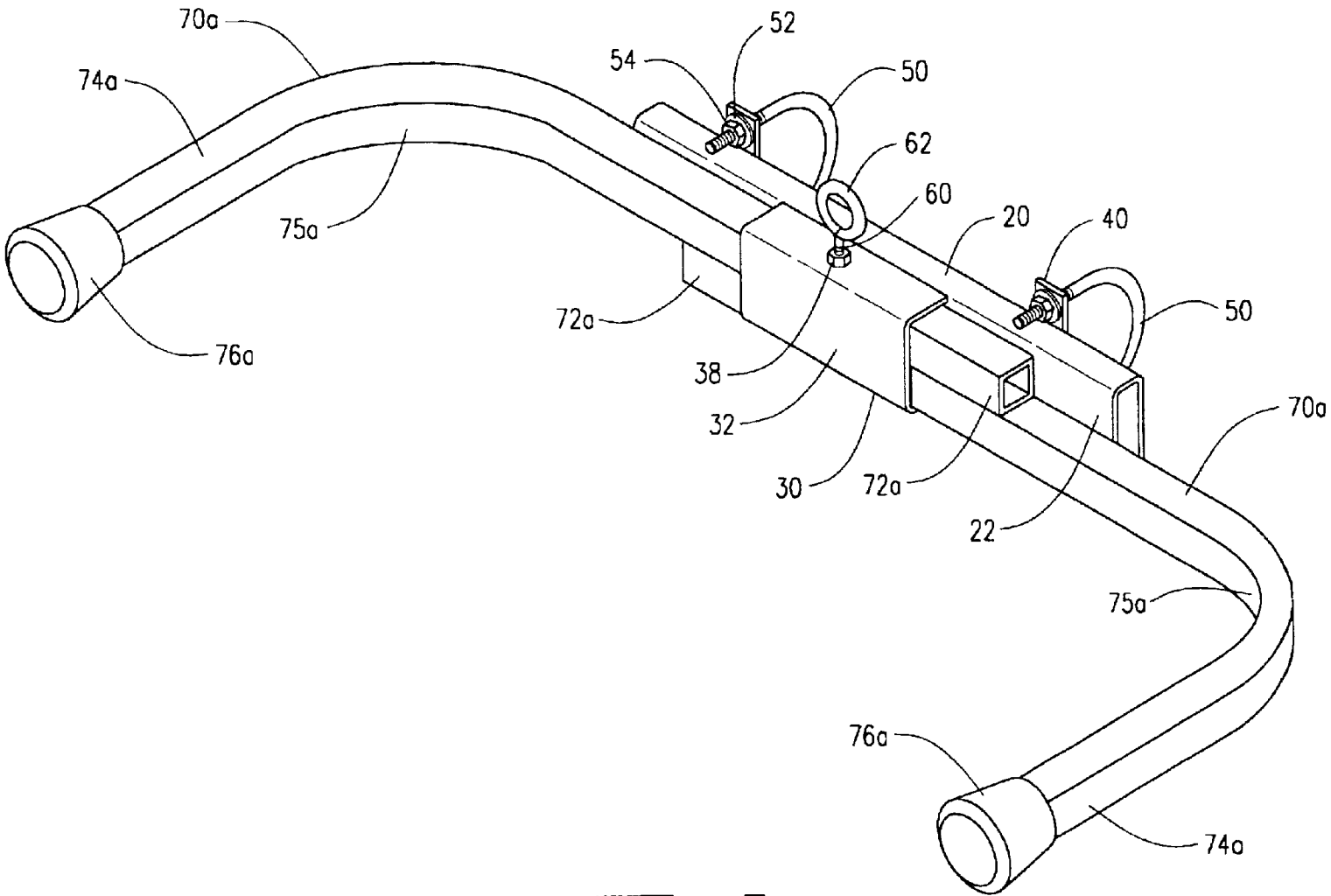
FIG. 1 is a perspective view of the ladder stabilizer with a first embodiment of the service arms.
Figure 2:
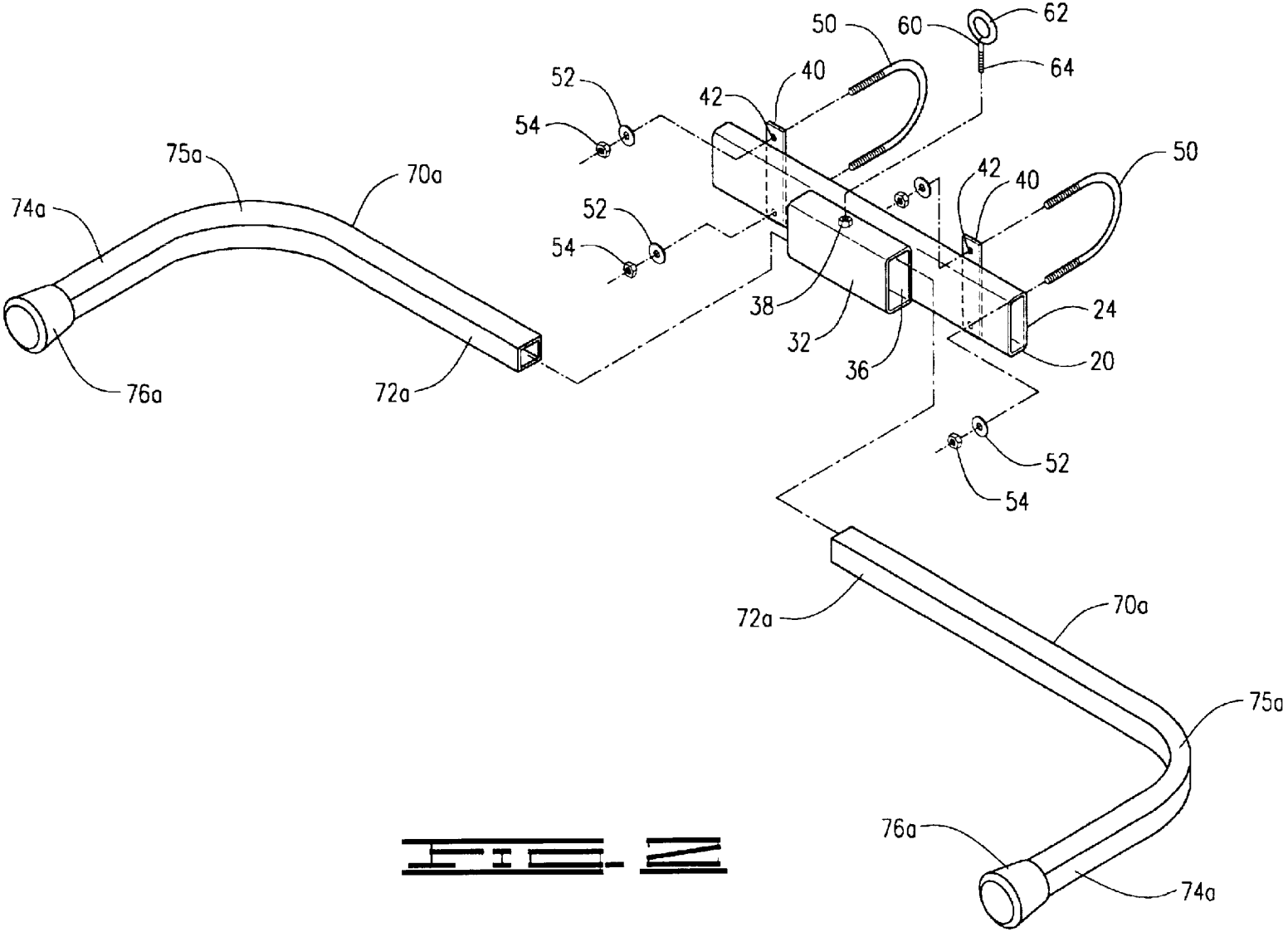
FIG. 2 is an exploded perspective view of the ladder stabilizer with the first embodiment service arms.
Figures 3, 4:
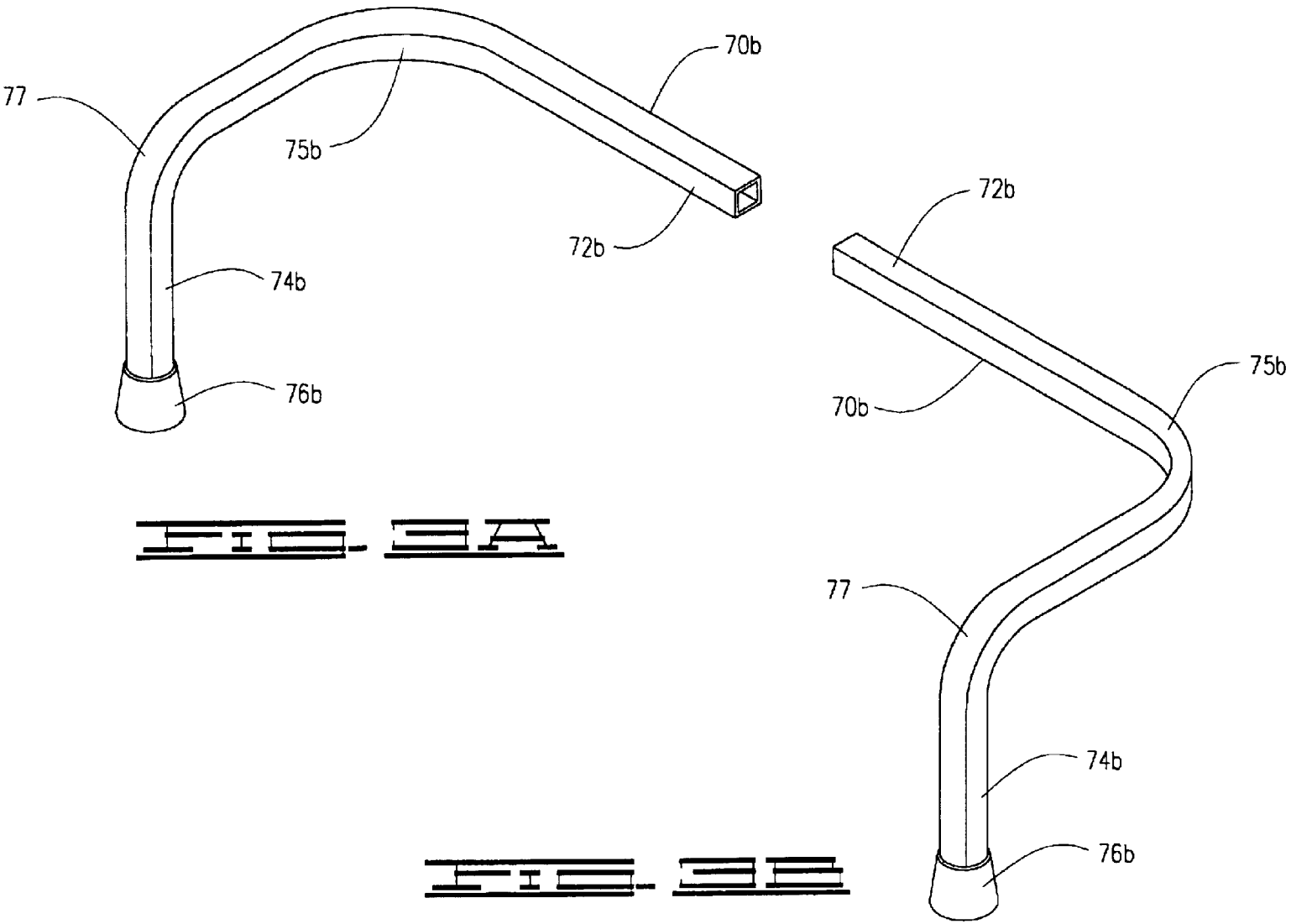
Figure 4:
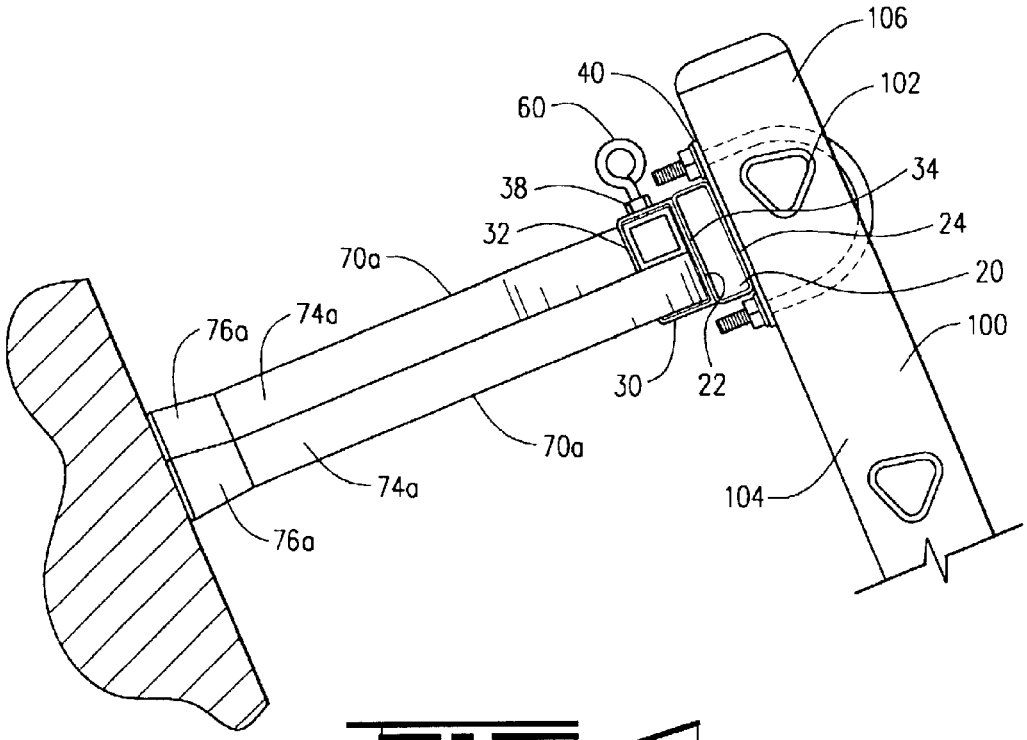

FIG. 4 is a side view of the ladder stabilizer on an upper end of an extension ladder utilizing the first embodiment service arms.

Figure 5:
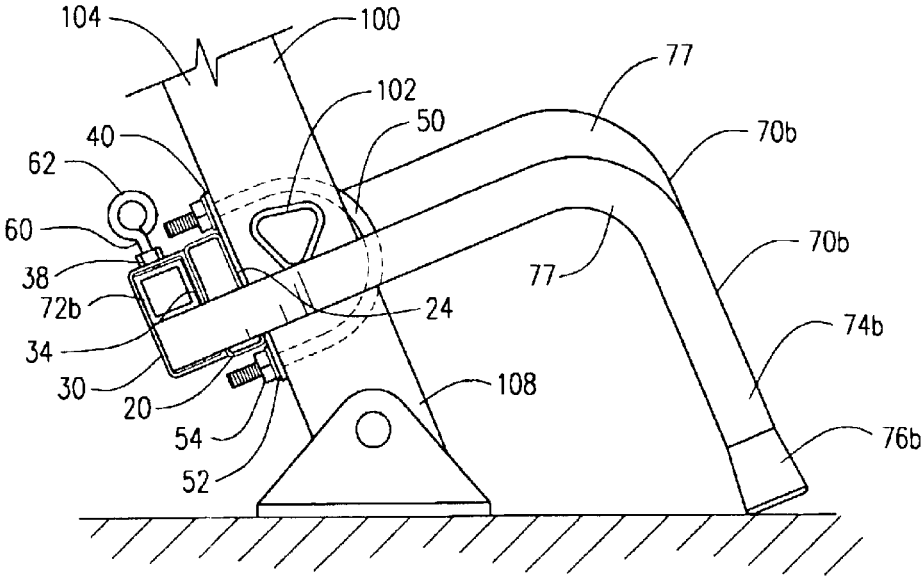

FIG. 5 is a side view of the ladder stabilizer on a lower end of an extension ladder utilizing the second embodiment service arms.

IV. DESCRIPTION OF THE PREFERRED EMBODIMENT

A ladder stabilizer, shown in FIGS. 1–5 of the drawings, adapted to attach to a rung 102 of an extension ladder 100, the ladder stabilizer comprising a main support bracket 20 having a front surface 22 and a rear surface 24, a sliding channel 30 having a front surface 32, a rear surface 34, an inner transverse sliding cavity 36, and an upper threaded bore 38, the rear surface 34 of the sliding channel 30 attached to the front surface 22 of the main support bracket 20, at least two U-bolt brackets 40 having a pair of vertically oriented holes 42 per each U-bolt bracket 40 attached to the rear surface 24 of the main support bracket 20, the pair of holes 42 in each U-bolt bracket 30 receiving a U-bolt 50 secured by washers 52 and nuts 54, the U-bolts 50 attaching each U-bolt bracket 40 to a common extension ladder rung 102, and two bent angled service arms 70*a*, 70*b*, slidingly engaged within the sliding channel 30, secured within the sliding cavity 36 at a chosen position by an externally threaded eye bolt 60 having a rounded eye 62 and a threaded engagement tip 64, the threaded engagement tip 64 engaging the upper threaded bore 38 into the sliding cavity 36 of the sliding channel 30, retaining the service arms 70*a*, 70*b*, stacked upon each other, within the sliding cavity 36 to laterally support the extension ladder 100. The ladder stabilizer may be attached to an upper end 106 of the extension ladder 100, to stabilize the extension ladder 100 against a surface upon which the extension ladder 100 is abutted, and may also be attached to a lower end 108 of the extension ladder 100 to stabilize the extension ladder 100 against the ground upon which it is placed.

The main support bracket 20 has a length greater than the width of the extension ladder 100 to which it is applied, primarily so that the main support bracket 20 will span the width of the extension ladder 100 to allow the rear surface 24 to rest against two side supports 104 of the extension ladder 100, aligned with the ladder rung 102 to which the U-bolts 50 would attach, the main support bracket 30 held against the side supports 104 by the application of the U-bolts 50 through the U-bolt brackets 40, as shown in FIGS. 4 and 5. The U-bolts 50 surround the ladder rung 102, engage the U-bolt brackets 40 by tightening the nuts 54, forcing the main support bracket 20 against the side supports 104 of the extension ladder 100 in a secure and immovable manner. It would be preferred to attach the ladder stabilizer to a back surface of the extension ladder, so that the ladder stabilizer would not impede the path of the user when climbing the extension ladder.

The most appropriate attachment for the sliding channel 30 and the main support bracket 20 would be by welding them together, as the entire ladder stabilizer is made entirely from a light weight and strong metal, such as aluminum or steel. Most preferably, as indicated in FIGS. 1–5, the sliding cavity 36 is rectangular and slightly larger than the dimension of the two service arms 70*a*, 70*b* stacked on top of each other. Likewise, the service arms 70*a*, 70*b* should be square in cross section, thus making the service arms 70*a*, 70*b* most preferably made of a square tubing of equal dimension. This square tubing within the rectangular sliding cavity 36 eliminates rotation of the service arms 70*a*, 70*b* within the sliding cavity 36, and allows for the service arms 70*a*, 70*b* to be positioned at four different positions within the sliding cavity 36 depending on the requirements for the extension ladder placement.

Once attached to the extension ladder 100, the main support bracket 20 and attached sliding channel 30 do not need to be removed from the extension ladder unless other placement is required in the use of the extension ladder. When required for use, the service arms 70*a*, 70*b* are installed within the sliding cavity 36 and secured within the sliding cavity 36 at a desired extension width by the eye bolt 60, held in place until conclusion of the activity, and then removed for transport.

The service arms 70*a*, 70*b* are provided in at least two embodiments, and provided as matched pairs of service arms. In a first embodiment, shown in FIGS. 1, 2 and 4 of the drawings, each service arm 70*a* includes a first end 72*a* and a second end 74*a*, with a single ninety degree bend 75*a* between the first end 72*a* and the second end 74*a*, the first end 72*a* being inserted within the sliding cavity 36, with the second end 74*a*, preferably having a friction enhancing safety sleeve 76*a* to reduce slipping, provided to rest against a wall or other surface against which the extension ladder 100 is to be placed. The second ends 74*a* of each service arm 70*a* are to be in opposing directions from each other. This first embodiment of the service arms 70*a* is preferred when using the extension ladder on a flat of uneven vertical surface, and also on a vertical pole, since the first embodiment service arms 70*a* may be collapsed in such manner as to "hug" opposing sides of the vertical pole to prevent any lateral movement of the upper end 106 of the extension ladder against the vertical pole. Attachment of the ladder stabilizer to the upper end 106 of the extension ladder 100 is shown in FIG. 4.

In a second embodiment, shown in FIGS. 3*a*, 3*b* and 5 of the drawings, the service arm 70*b* is provided as matched pairs, but Mirror images of each other; as indicated by the different second bend found in FIGS. 3*a* versus 3*b*. In the second embodiment there is a first end 72*b* and a second end 74*b*, two bends are provided, a first bend 75*b* being a ninety degree bend on an X-Y axis, and the second bend 77 being another ninety degree bend, but in a Y-Z axis or a perpendicular axis, as shown in FIG. Y of the drawings. The second end 74*b* also includes a friction enhancing safety tip 76*b*, with the second ends 74*b* directed in opposing directions when the service arms 70*b* are place within the sliding cavity 36. These second embodiment service arms 70*b* are preferred in use for securing the extension ladder 100 upon a pitched roof, over guttering, or simply resting upon a roof when working on a flat vertical wall without having the extension ladder 100 make contact with the vertical wall. These second embodiment service arms 70*b* are preferred when applying the ladder stabilizer to the bottom end 108 of the extension ladder 100, preventing movement of the bottom end of the extension ladder on a ground surface in any direction, FIG. 5.

As each service arm 70*a*, 70*b* moves independently within the sliding cavity 36, the service arms 70*a*, 70*b* may be positioned with the second ends 74*a*, 74*b* at any distance apart provided by the length of each service arm based upon the distance between the first end 72*a*, 72*b* and second end 74*a*, 74*b*. When secured within the sliding cavity 36 by the force of the threaded engagement tip 64 of the eyebolt 60 against the stacked service arms 70*a*, 70*b* within the sliding cavity 36, the service arms 70*a*, 70*b* may not be moved, either laterally or rotatably within the sliding cavity 36 unless the eyebolt 60 is disengaged, allowing for lateral movement of the service arms within the sliding channel 36.

It is also contemplated within the scope of the invention that the rounded eye 62 of the eyebolt 60 may be used as a hook for hanging objects once engaged to secure the service arms within the sliding cavity. It is also contemplated that the front surface 32 of the sliding channel 30 may include a mounting bracket, not shown, for attaching accessories, including winches, pulleys and hoists for lifting objects to the upper end of the extension ladder. Hook holes, also not shown, may be provided on the main support bracket 20 for attaching band strap hooks within the holes to apply a band strap as additional stabilization of the extension ladder while working on the vertical pole, previously mentioned, the band strap completely wrapping the vertical pole, both by the service arms and additionally by the band strap.

While the invention has been particularly shown and described with reference to a preferred embodiment thereof, it will be understood by those skilled in the art that changes in form and detail may be made therein without departing from the spirit and scope of the invention.

What is claimed is:

1. A ladder stabilizer adapted to attach to a common ladder rung of an extension ladder, the ladder stabilizer comprising:

a main support bracket having a front surface and a rear surface;

a sliding channel having a front surface, a rear surface, an inner transverse sliding cavity, and an upper threaded bore, said rear surface of said sliding channel attached to said front surface of said main support bracket;

at least two U-bolt brackets having a pair of vertically oriented holes per each said U-bolt bracket attached to said rear surface of said main support bracket;

at least two U-bolts, secured by washers and nuts, received within said pair of holes, one of each said U-bolts engaging each said U-bolt bracket, each said U-bolt attaching each said U-bolt bolt bracket to the common extension ladder rung;

two bent angled service arms, slidingly engaged within said sliding channel;

an externally threaded eye bolt having a rounded eye and a threaded engagement tip, said threaded engagement tip penetrating said upper threaded bore into said sliding cavity of said sliding channel, retaining said service arms, stacked upon each other, within said sliding cavity to laterally support the extension ladder.

2. The ladder stabilizer as disclosed in claim 1, wherein:

said sliding cavity is rectangular; and said service arms are square in cross section, preventing rotation of said service arms within said sliding cavity when retained within said sliding channel by said eyebolt.

3. The ladder stabilizer as disclosed in claim 1, wherein said sliding cavity is rectangular and said service arms are square in cross section, eliminating rotation of said service arms within said sliding cavity when retained within said sliding channel by said eyebolt, said service arms further comprising:

a first end and a second end, said first end bent at a ninety degree angle from said second end, said first end inserted within said sliding cavity, with said second end having a friction enhancing safety sleeve.

4. The ladder stabilizer as disclosed in claim 1, wherein said sliding cavity is rectangular and said service arms are square in cross section, eliminating rotation of said service arms within said sliding cavity when retained within said sliding channel by said eyebolt, said service arms further comprising:

a first end and a second end, between which are placed a first bend and a second bent, said first bend is a ninety degree bend, and said second bend is a ninety degree bend, but in a perpendicular axis, said second end also includes a friction enhancing safety tip.

* * * * *